United States Patent [19]

Simko

[11] 4,102,227

[45] Jul. 25, 1978

[54] METHOD OF AND APPARATUS FOR ALIGNING A SCORING WHEEL WITH A SUPPORT WHEEL

[75] Inventor: Gabriel Simko, Springdale Township, Allegheny County, Pa.

[73] Assignee: PPG Industries, Inc., Pittsburgh, Pa.

[21] Appl. No.: 682,425

[22] Filed: May 3, 1976

[51] Int. Cl.[2] ..... B26D 3/08

[52] U.S. Cl. ..... 83/7; 83/498; 83/368; 250/208; 225/2

[58] Field of Search ..... 83/7, 11, 368, 498, 83/499, 12; 225/2; 250/208

[56] References Cited

U.S. PATENT DOCUMENTS

| | | | |
|---|---|---|---|
| 3,176,566 | 4/1965 | Patterson | 83/498 |
| 3,240,090 | 3/1966 | Bognar | 83/7 |
| 3,675,024 | 7/1972 | Benard | 250/208 |

*Primary Examiner*—Donald R. Schran
*Attorney, Agent, or Firm*—Donald Carl Lepiane

[57] ABSTRACT

A plurality of scoring assemblies each having a scoring wheel are selectively positioned above and transverse to a glass sheet movement path and in spaced relation to a plurality of support assemblies. Each of the support assemblies are mounted on a common shaft for movement below the sheet movement path and include a laser mounted in predetermined spaced relation to a support wheel. Respective ones of the support wheels are aligned with their respective ones of the scoring wheel when the laser beam is incident on the center of a photodetector spaced from the scoring wheel. The support assemblies are moved into alignment with their respective ones of the scoring assemblies by rotating the shaft to move a selected one of the support assemblies into alignment with a selected one of the scoring assemblies while the remaining support assemblies are held stationary. The above is sequentially repeated to align the remaining ones of the scoring assemblies with their respective one of the support assemblies.

20 Claims, 5 Drawing Figures

FIG. 1
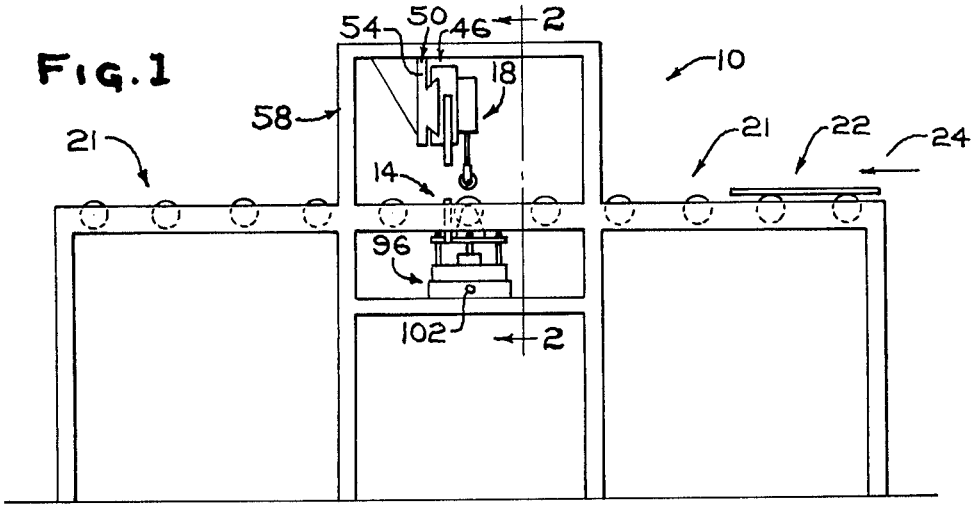
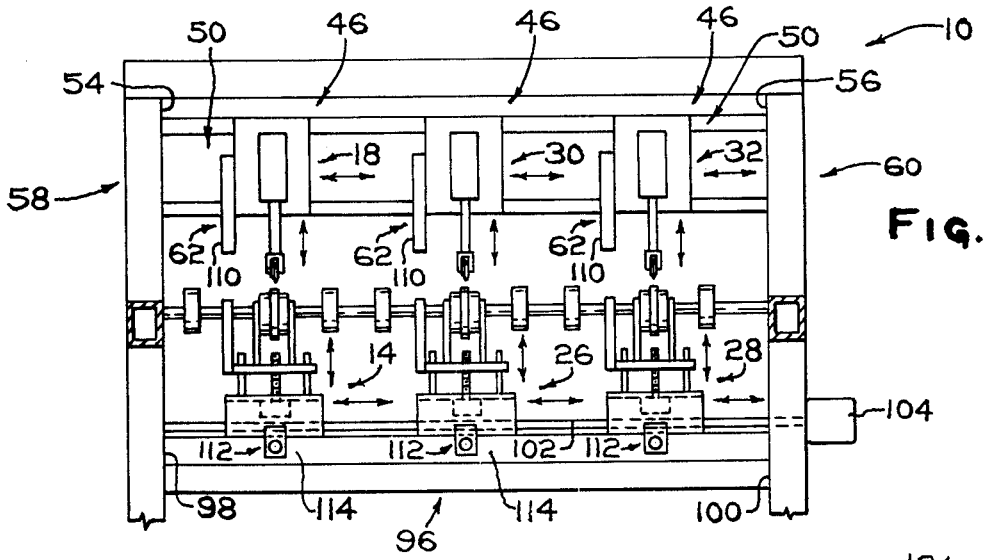
FIG. 2
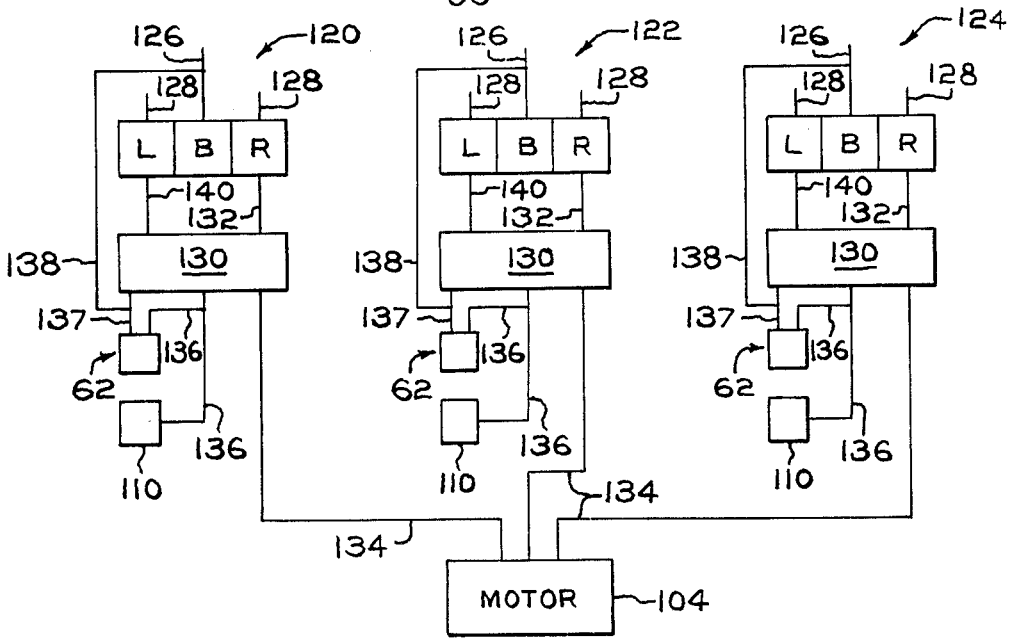
FIG. 5

METHOD OF AND APPARATUS FOR ALIGNING A SCORING WHEEL WITH A SUPPORT WHEEL

BACKGROUND OF THE INVENTION

1. Field of the Invention

This invention relates to a method of and apparatus for aligning ones of a plurality of scoring wheels with ones of a plurality of support wheels, e.g., lands using a laser and a position photodetector.

2. Discussion of the Technical Problems and Prior Art

In the practice of scoring refractory materials such as glass, ceramics, and glass ceramics, a wheel support, e.g., a land is employed to reduce scoring force required to produce a given fissure depth. The scoring surface of a scoring wheel and land should be aligned with one another to, among other things, (1) introduce a stress field between the scoring wheel and land to produce a deep score and (2) provide a cut edge on the refractory material that is perpendicular to the major surface of the refractory material. In this manner, the edge strength of the cut edge is enhanced.

In the prior art, the use of a laser and photodetector is known to align machine tools, and front end of automobiles as taught in U.S. Pat. Nos. 2,343,785; 3,348,057; and 3,865,492. The use of a laser and photodetectors is known in the micro circuitry technology as taught in U.S. Pat. Nos. 3,551,057 and 3,675,024. Other uses of lasers are taught in U.S. Pat. Nos. 3,351,767; 3,432,240; 3,603,688; and 3,637,309.

Although some technologies use a photodetector and a laser as above mentioned, there is no teaching in the prior art that a photodetector and a laser may be used to align a scoring wheel with a support wheel.

SUMMARY OF THE INVENTION

This invention relates to a method of positioning in predetermined spaced relationship respective ones of a first set of a plurality of discrete objects, e.g., scoring assemblies mounted for movement along a first predetermined path with respective ones of the second set of a plurality of discrete objects, e.g., support assemblies selectively mounted for movement along a second predetermined path. The first and second predetermined paths are in spaced relationship to one another.

The method includes the steps of applying a first force to simultaneously move each of the support assemblies along the first predetermined path in a direction to position a selective one of the support assemblies in predetermined spaced relationship with its respective one of the scoring assemblies while a second force is applied to prevent movement of the remaining support assemblies. Thereafter the aligned support assembly is secured in position.

This invention also relates to a method of aligning peripheral center of a scoring wheel of a scoring assembly with peripheral center of a land of a support assembly. A first discrete portion of position detecting facilities is mounted on the scoring assembly in spaced relation to the scoring wheel and a second discrete portion of the detecting facilities is mounted on the support assembly in spaced relation to the land.

The scoring assembly and support assembly are displaced relative to one another while output signal of the detecting facilities is monitored. The assemblies are secured in position when the peripheral centers of the scoring wheel and land are aligned as indicated by the output signal of the detecting facilities.

Further this invention relates to an apparatus for aligning peripheral centers of a scoring wheel of a scoring assembly and a land of a supporting assembly about an article movement path. Facilities mount (1) the scoring assembly on one side of the article movement path for moving the scoring assembly along a first predetermined path and (2) the support assembly on the other side of the article movement path for moving the support assembly along a second predetermined path. The predetermined paths are in spaced relationship and lie in a plane that is normal to the article movement path and intersects the axial center of the scoring wheel and land.

Position detecting facilities have a first part mounted on the scoring assembly in spaced relationship to the peripheral center of the scoring wheel and a second part mounted on the support assembly in spaced relation to the peripheral center of the land such that the detecting facilities have a given output signal when the peripheral center of the scoring wheel and land are aligned. Facilities displace at least one of the moving facilities to move its respective assembly in the direction to align the peripheral center of the scoring wheel and land. Facilities responsive to the output signal of the detecting facilities and acting on the displacing facilities secure at least one of the moving facilities in position when the scoring wheel and land are aligned.

Still further, this invention relates to an apparatus for positioning in predetermined spaced relationship a first set of a plurality of objects, e.g., scoring assemblies with a second set of a plurality of objects, e.g., support assemblies. The apparatus includes facilities mounting the first set of objects for moving each of the first set of objects along a first predetermined path and facilities for simultaneously moving the second set of objects along a second predetermined path in spaced relationship to the first predetermined path.

Position detecting facilities mount each of the objects of the first and second set. Each of the position detecting facilities include (1) a first part mounting the first set of objects and a second part mounting the second set of objects and (2) facilities for generating a predetermined signal when respective ones of the first set are in spaced alignment with respective ones of the second set.

Stop facilities act on each of the objects of the second set to prevent movement of selected ones of the objects of the second set while a selected one of the objects of the second set is moved to position the selected one of the objects of the second set with a selected one of the objects of the first set. Facilities responsive to the output signal of the detecting facilities act on the stop facilities to operate the stop facilities when the selected one of the second objects is in predetermined spaced alignment with the selected one of the first objects as indicated by the given output signal of the detecting facilities.

BRIEF DESCRIPTION OF THE DRAWING

FIG. 1 is a side elevated view of a scoring station incorporating features of the invention;

FIG. 2 is a view taken along lines 2—2 of FIG. 1;

FIG. 5 is a schematic of a plurality of electrical systems that may be used in the practice of the invention to align the scoring wheel of the scoring assembly with the support wheel of the support assembly.

DESCRIPTION OF THE INVENTION

Figure 3:
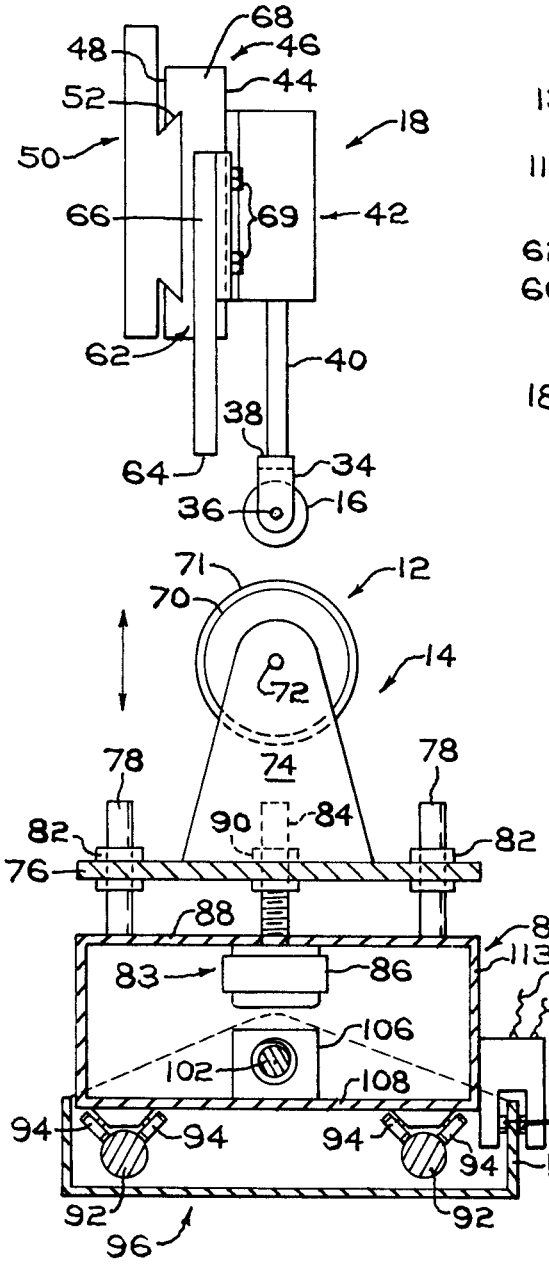
FIG. 3 is a side elevated view having portions removed for purposes of clarity of a scoring assembly having its scoring wheel aligned with a support wheel of a support assembly in accordance to the teachings of the invention.
Figure 4:
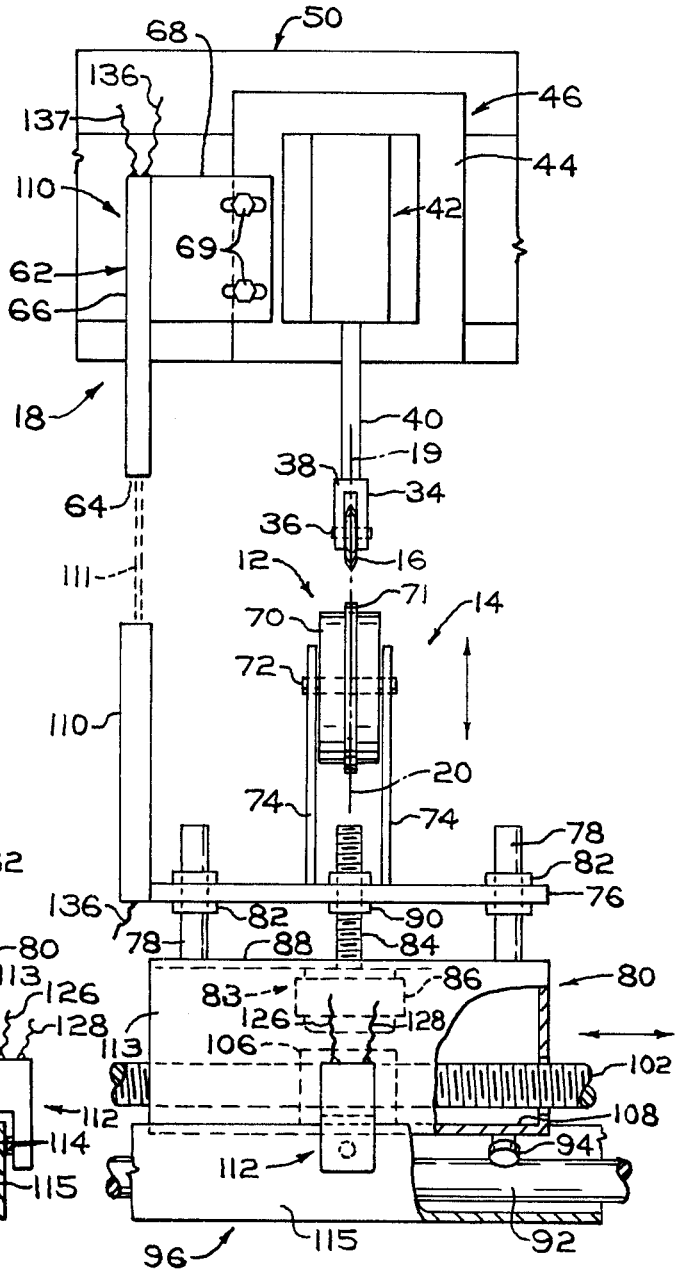
FIG. 4 is a front elevated view of the scoring assembly and support assembly of FIG. 3.

With reference to FIGS. 1 and 2, there is shown a scoring station 10 which may be used in the practice of the invention to align peripheral centers of a support wheel or land 12 of support assembly 14 and scoring wheel 16 of scoring assembly 18 as shown in FIGS. 3 and 4.

The term "peripheral center of the scoring wheel" as used herein is defined as a plane normal to a line passing through the rotating axis of the scoring wheel and passing between major surfaces of the scoring wheel to intersect the apex of the scoring surface of the scoring wheel. The plane is designated by numeral 19 in FIG. 4. The term "peripheral center of the land" as used herein is defined as a plane normal to a line passing through the rotating axis of the land and passing between major surfaces of the land and intersecting the supporting surface of the land. The plane is designated as numeral 20 in FIG. 4.

In general, the scoring station 10 of FIGS. 1 and 2 include powered donut conveyor 21 of the type used in the art to covney a glass sheet 22 along an article movement path designated by the direction of the arrow 24 toward, between and past the land assembly 14 and scoring assembly 18. As the glass sheet 22 moves between the land assembly 14 and scoring assembly 18, the glass sheet is scored along a predetermined score path in a manner to be discussed below.

Although the invention will be discussed to score a glass sheet, it will become apparent that the invention is not limited thereto. For example, the invention may be used to score a glass ribbon or other refractory materials such as ceramics, e.g., MONOFRAX® ceramics sold by Carborundum Corporation and glass-ceramics, e.g., HERCUVIT® glass-ceramics sold by PPG Industries, Inc.

Referring now to FIGS. 1 and 2, and more specifically to FIG. 2, three support assemblies 14, 26 and 28 are mounted on one side of the article movement path 24, e.g., below the article movement path and three scoring assemblies 18, 30 and 32 are mounted on the opposite side of the article movement path 24, e.g., above the article movement path. As will become apparent, the invention is not limited to the number of support assemblies or scoring assemblies used in the practice of the invention.

With reference to FIGS. 3 and 4, the discussion will be directed to the scoring assembly 18 with the understanding that the discussion is applicable to scoring assemblies 30 and 32 unless indicated otherwise.

The scoring assembly 18, in general, includes the scoring wheel 16 of the type used in the art rotatably mounted between bifurcated member 34 by way of shaft 36. The bifurcated member 34 is advantageously connected at 38 to a piston rod 40 of double action air cylinder 42 to move the scoring wheel 16 toward the article movement path 24 under a predetermined scoring force and away from the article movement path 24. The air cylinder 42 is advantageously secured to surface 44 of block 46 and opposed surface 48 of the block is movably mounted on lateral structural member 50 by way 52. In this manner, the scoring assemblies 18, 30 and 32 are moved and positioned along a reciprocating path transverse to the article movement path 24.

The scoring assemblies 18, 30 and 32 are supported above the article movement path 24 in any conventional manner. For example, ends 54 and 56 of the member 50 are secured to structural A frames 58 and 60, respectively, as shown in FIGS. 1 and 2 in any conventional manner.

A position detector assembly 62 including a position photodetector 64 secured to rod 66 is secured to the block 46 for lateral adjustment with respect to the scoring wheel 16 by way of plate 68 and screws 69 as shown in FIG. 4. The photodetector 64 preferred in the practice of the invention is the type that has a voltage output as a function of position of a light beam on the photodetector surface.

With reference to FIGS. 3 and 4, the discussion will be directed to the support assembly 14 with the understanding that the discussion is applicable to support assemblies 26 and 28 shown in FIG. 2 unless indicated otherwise.

The land 12 is of the type used in the art and includes a wheel member 70 having a radial rib 71. The land 12 is rotatably mounted by way of shaft 72 between bifurcated member 74 advantageously mounted on movable platform 76.

The platform 76 is mounted for movement toward and away from the article movement path 24 in any conventional manner. For example, spaced vertical posts 78 are secured at one end to housing 80 and pass through a respective bearing 82 mounted in the platform 76 as shown in FIGS. 3 and 4. Elevator facility 83 includes a threaded shaft 84 having one end powered by motor 86 secured within the housing 80. The shaft 84 passes through upper wall 88 of the housing 80 and is threaded in nut 90 mounted in the platform 76.

Rotating the shaft 84 in a first direction moves the land toward the article movement path, and rotating the shaft 84 in a second opposite direction moves the land away from the article movement path 24.

The housing 84 is movably mounted below the article movement path 24 on guiderails 92 by wheels 94 as shown in FIG. 3. The guiderails 92 are mounted in spaced relationship within U-shaped member 96. The member 96 is secured at its ends 98 and 100 to structural A frame members 58 and 60, respectively, as shown in FIG. 2.

The housing 80 is moved along a reciprocating path transverse to the article movement path 24 by a shaft 102 having one end powered by motor 104 (shown in FIG. 2). The shaft 102 passes through gear box 106 mounted on inner surface 108 of the housing 80 and has its other end rotatably mounted adjacent end 98 of the member 96 in any conventional manner. Rotating the shaft 102 in a first direction laterally moves the land assembly 14 in a first lateral direction and rotating the shaft 102 in a second opposite direction laterally moves the land assembly 14 in a second lateral direction opposite to the first lateral direction as shown in FIG. 2.

Referring back to FIG. 4, a laser 110 is advantageously mounted in spaced parallel relationship to the supporting surface or radial rib 71 of the land 12 to direct a collimated beam of light 111 upward as viewed in FIG. 4. Although not shown in FIG. 4, for purposes of clarity, the laser 110 may be mounted for lateral registration with the land in a similar manner as the photodetector is mounted for lateral registration with the scoring wheel. The diameter of the light beam from the laser is smaller than the active diameter of the detector 64. As will become apparent, the invention is not limited to a laser and any type of light system for generating a collimated beam of light or focusing a beam on the detector may be used in the practice of the invention.

The distance between the centroid of the laser beam 111 of the laser 110 and the peripheral center of the land 12 is preferably equal to the distance between the center of the photodetector surface 64 and the peripheral center of the scoring wheel 16. In this manner, when the laser beam is incident on the center of the photodetector surface as indicated by the output signal of the detector 64 the peripheral centers of the scoring wheel 16 and the land 12 are aligned.

As can now be appreciated, the invention is not limited to the laser beam 111 incident on the center of the detector surface 64 to align the peripheral centers of the scoring wheel 16 and land 12. For example, the peripheral centers of the scoring wheel 16 and land 12 may be aligned with the laser beam 111 incident on the surface of the detector 64. The output signal of the detector 62 is then adjusted to a zero output signal in any conventional manner.

The invention will now be discussed to align the support assemblies with their respective ones of scoring assemblies. For example, align support assemblies 14, 26 and 28 with scoring assemblies, 18, 30 and 32, respectively, as shown in FIG. 2.

The support assemblies 14, 26 and 28 are as previously discussed and with reference to FIGS. 3 and 4, further include the following. Each of the support assemblies includes a brake assembly 112 mounted in any conventional manner on sidewall 113 of the housing 80 as shown in FIGS. 3 and 4. The brake assembly 112 includes a caliper brake 114 mounted about sidewall 115 of the member 96. In the engaging position, the brake 114 frictionally engages the sidewall 115 as shown in FIG. 3 to secure the support assembly in position.

The gear box 106 is of the type that (1) moves the support assembly when the brake 114 is in a non-engaging position and (2) prevents movement of the support assembly when the brake 114 is in the engaging position while the shaft 102 continues to rotate. This type of gear is taught in U.S. Pat. No. 3,272,021, the teachings of which are hereby incorporated by reference.

Referring now to FIGS. 2 and 5, each of the support assemblies 14, 26 and 28 and scoring assemblies 18, 30 and 32 is associated with control circuits 120, 122 and 124, respectively, to control the movement of its respective support assembly and actuate the photodetector 62 and laser 110. The circuits 120, 122 and 124 are identical in construction. Therefore, the discussion will be directed to circuit 120 with the understanding the discussion is applicable to circuits 122 and 124 unless indicated otherwise.

With specific reference to FIGS. 3–5, the brake 114 of the support assembly 14, 26 and 28 is moved into the engaging position by pressing brake button designated by the letter "B". For example, depressing "B" button forwards a signal by way of cable 126 to the brake assembly 112 to move the brake 114 into frictional engagement with the sidewall 115 of the member 96 to prevent movement of the support assemblies 14, 26 and 28.

The support assembly 14 is moved to the right as viewed in FIG. 2 by depressing the "R" button to (1) forward a signal by way of cable 128 to the brake assembly 112 to move the brake 114 into the non-engaging position and (2) forward a signal to relay circuit 130 by way of cable 132. The relay circuit 130 forwards (1) a signal to the motor 104 by way of cable 134 to energize the motor 104 to rotate the shaft 102 in a first direction to move the support assembly 14 to the right as viewed in FIG. 2 and (2) a signal to laser 110 and photodetector 62 by way of cables 136 to energize same.

The support assemblies 26 and 28 remain stationary because their respective brake 114 is in the engaging position.

The support assembly 14 moves to the right until the laser beam 111 from the laser 110 is incident on the surface of the detector 64 as indicated by the output signal of the photodetector 64. When the peripheral centers of the scoring wheel 16 and land 12 are aligned, the photodetector 62 forwards (1) a signal by way of cable 137 to the relay 130 to deenergize the motor 104; (2) a signal by way of cable 138 and 126 to move the brake 113 into the engaging position and (3) a signal by way of the cable 137 to relay 130 to deenergize the photodetector and laser.

The support assembly 14 is moved to the left as viewed in FIG. 2 by depressing the "L" button to (1) forward a signal by way of the cable 128 to move the brake 114 into the non-engaging position; and (2) forward a signal by way of cable 140 to the relay 130. The relay 130 forwards a signal by way of cable 134 to energize the motor 104 to rotate the shaft in a second direction to move support assembly 14 to the left as viewed in FIG. 2, and (2) a signal by way of the cable 136 to energize the laser and photodetector.

The support assemblies 26 and 28 remain stationary because their respective brake 114 is in the engaging position.

When the peripheral center of the land 12 and scoring wheel 16 are alinged as indicated by the output signal of the photodetector 64, the motor 104, photodetector 64 and laser 110 are deenergized and (2) the brake 114 moved into the engaging position as previously discussed.

As can be appreciated, the invention is not limited to the discussion presented. For example, a system for automatically moving the scoring assemblies similar to that for moving the support assemblies may be used.

The invention may also be practiced on a glass sheet; glass ribbon; or any other transparent sheet material moves between the support assembly 14 and scoring assembly 18.

When practicing the invention with a glass sheet or glass ribbon, consideration has to be given to optical defects in the glass ribbon or to variations in glass thickness. As can be appreciated by those skilled in the art, a beam of light passing through an optical defect in a glass sheet deviates from its normal path. If the deviation is not considered, the peripheral centers of the land and scoring wheel will not be aligned. The above is illustrated by the following example.

Displacement error of a transmitted beam of light through a glass sheet is equal to the product of the deviation angle in radians and the distance of the detector surface from adjacent glass surface. The deviation angle is equal to the product of glass wedge angle and the refractive index minus one. In equation form, the above is as follows:

$$E = \delta l = (n\text{-}1)\,\alpha l$$

where: E is the error due to glass irregularity;

$\delta$ is the deviation angle of the transmitted beam of light;

$l$ is the distance of the detector from the adjacent glass surface;

$\alpha$ is the glass wedge angle; and $n$ is the refractive index of the glass.

It has been found that for commercially acceptable glass, setting the detector less than about 1 foot (0.3 meter) from the adjacent glass surface limits the error to $\pm 1/64$ inch (0.04 centimeter). In other words, the peripheral center of the land and scoring wheel will be aligned to plus or minus about 1/64 inch (0.04 centimeter).

As can be appreciated, the optical defects in the glass or wedge angle can be compensated by increasing the width of the land rib 71. However, it has been found that maintaining the width of the land rib 71 as small as possible provides for more acceptable pinching of the glass between the land rib and scoring wheel. In other words, a more acceptable stress field is introduced in the glass for subsequent scoring of the glass along the score line.

DETAILED DESCRIPTION OF THE INVENTION

The scoring station 10 of FIG. 1 incorporating features of the invention is used to slit score a glass sheet 22, i.e., score the glass sheet from the leading edge to the trailing edge. The glass sheet has a length of about 10 feet (3 meters) as measured between the leading edge and trailing edge, a width of about 5 feet (1.5 meters) and a thickness of about ¼ inch (0.635 centimeters).

Referring to FIGS. 1 and 2, the scoring station 10 includes a powered donut conveyor 21 of the type used in the art for moving the glass sheet 22 along an article movement path in the direction of the arrow 24. The conveyor 21 has a width of about 6 feet (1.8 meters) and a length of about 25 feet (7.5 meters).

Mounted at approximately the lateral center of the conveyor and spaced about 4.5 inches (11.4 centimeters) above the top of the article movement path 24 is a rectangular shaped hollow lateral structural member 50 for supporting scoring assemblies 18, 30 and 32 above the article movement path 24. The structural member is supported at ends 54 and 56 to structure A frames 58 and 60, respectively, and has dimensions of about 7 feet (2.1 meters) long; 8 inches (20.3 centimeters) high; 4 inches (10.2 centimeters) wide and a wall thickness of about ½ inch (1.27 centimeters).

The scoring assemblies 18, 30 and 32 are identical in construction and the discussion will be directed to the scoring assembly 18 with the understanding that the discussion is applicable to assemblies 30 and 32 unless indicated otherwise.

With reference to FIGS. 3 and 4, the scoring assembly 18 includes a block 46 slideably mounted on the structural member by a way 52 formed in surface 48 of the block 46. The block 46 has a height of about 8 inches (20.3 centimeters); a length of about 6 inches (15.2 centimeters) and a thickness of about 4 inches (10.2 centimeters).

A double action air cylinder 42 of the type used in the art is advantageously mounted to surface 44 of the block 46 and has its piston rod 40 facing the article movement path. A bifurcated member 34 is mounted at 38 to the rod 40 and has a scoring wheel 16 rotatably mounted therein by way of shaft 36. The cylinder 42 is adjusted on the block 46 such that the rod 40 in the fully extended position, spaces the wheel slightly less than about ¼ inch (0.62 centimeter). above the conveyor 21.

The scoring wheel 16 is of the type used in the art and has a diameter of about 2 inches (5.08 centimeters) and a scoring angle of about 165°.

Mounted on the block 46 by way of plate 68 and screws 69 and spaced from the cylinder 42 is a position photodetector 62 having detector 64 of the type sold by United Detector Technology Inc., Model No. PINSC/10. The center of the detector surface is on a center-to-center spacing with the peripheral center of the scoring wheel of about 5¼ inches (13.2 centimeters) and spaced about 4.5 inches (10.8 centimeters) above the article movement path.

The discussion will now be directed to the support assemblies 14, 26 and 28 shown in FIG. 2.

With reference to FIGS. 3 and 4, the support assembly 14 will be described with the understanding that the discussion is applicable to support assemblies 26 and 28 unless indicated otherwise. The support assembly 14 includes a rectangular shaped housing 80 having a wall thickness of about ¼ inch (0.62 centimeter), a height of about 4 inches (10.2 centimeters), a length of about 6 inches (15.2 centimeters) and a width of about 8 inches (20.3 centimeters).

Vertical posts 78 having a diameter of about ½ inch (1.27 centimeters) and a length of about 4 inches (10.2 centimeters) are mounted on surface 88 of the housing adjacent the corners as shown in FIGS. 3 and 4. A 1 inch (2.54 centimeter) thick platform 76 has bearings 82 mounted therein which bearings are slideable on the posts 78. The platform 76 is raised and lowered by way of motor 86 mounted within the housing and threaded shaft 84 passing through the wall 88 of the housing and threaded into nut 90 mounted in the center of the platform. In this manner, the land 12 is moved toward and away from the article movement path.

The land 12 is a wheel 70 having a diameter of about 4 inches (10.2 centimeters), a thickness of about 4 inches (10.2 centimeters) and a rib 71 having a diameter of about 4½ inches (11.3 centimeters) and a thickness of about ¼ inch (0.62 centimeter) as shown in FIGS. 3 and 4. The land is rotatably mounted between bifurcated members 74 by way of a 1 inch (2.54 centimeter) diameter shaft. The bifurcated members, in turn, are mounted on the platform 76.

A Metrologic He-Ne Laser Model No. LM610 designated by numeral 110 is mounted adjacent the left side of the platform 94 as shown in FIGS. 3 and 4 to direct a light beam 111 toward the article movement path. The laser beam is on a center-to-center spacing of 5¼ inches (13.8 centimeters) with the peripheral center of the land 12. The upper end of the laser 110 is spaced about 3 inches (7.82 centimeters) above the platform 76.

The support assembly 14 is movably mounted on guiderails 92 by way of wheels 94 as shown in FIG. 5. The guiderails 92 are mounted within U shaped member 96 having its ends 98 and 100 secured to structural members 58 and 60 as shown in FIG. 2 and spaced from the article movement path 24. The support assembly 14 is moved along the guiderails 92 by shaft 102 having an end freely mounted for rotation and the other end connected to motor 104 as shown in FIG. 2. The shaft 102 passes through a ROH'LIX linear actuator Model 4 sold by Barry Controls of Watertown Massachusetts designated by numeral 106 in FIGS. 3 and 4. The actuator 106 is securely mounted on inner surface 108 of the housing 80.

A brake assembly 112 having a caliper brake 114 of the type sold by TOL-O-MATIC Model No. HP 10-S is attached to the sidewall 113 of the housing 80 and positioned about leg 115 of the U shaped member 96 as shown in FIG. 3.

Referring to FIG. 1, the structural member 54 and U shaped member 96 are positioned such that an imaginary plane normal and transverse to the article movement path passes through the axial center of the scoring wheel 16 and land 12 of the scoring assemblies 18, 30 and 32 and support assemblies 14, 26 and 28, respectively, to provide optimum pinching of the glass sheet 22.

A first glass sheet is to be slit scored to provide 4 sections each about 1¼ feet (0.375 meter) wide. A second glass sheet is to be slit scored to provide 2 sections each about 1¼ feet (0.375 meter) wide and one section 2½ feet (0.75 meter). A third sheet is to be slit scored having 2 sections each about 1¼ feet (0.375 meter) wide, 1 section 1¾ feet (0.525 meter) wide and one section about ¾ feet (0.225 meter) wide.

With reference to FIG. 2, the scoring assemblies 18, 30 and 32 are to the left side of the conveyor 10 and the support assemblies 14, 26 and 28 are to the right side of the conveyor 10. The scoring assemblies are moved along the member 50 to position the scoring assembly 30 at the longitudinal center of the conveyor 10, the scoring assembly 18 to the left of the scoring assembly 30 and the scoring assembly 32 to the right of the scoring assemblies. The distance between the peripheral center of adjacent scoring wheels is 1¼ feet (0.375 meter) measured in any conventional manner.

With reference to FIG. 5, brake button "B" for circuits 122 and 124 are depressed to forward a signal by way of cable 126 to energize the brake assembly 112 of support assemblies 26 and 28, respectively, to move the brake 114 into frictional engagement with the sidewall 115. Visual observation shows that support assembly 14 is to the right of the scoring assembly 18 and therefore the support assembly 18 has to be moved to the left to align the scoring wheel 16 and land 12 of assemblies 18 and 14, respectively. The left movement button "L" is depressed to forward (1) a signal by way of cable 128 to disengage the brake 114 of support assembly 14 and (2) a signal by way of cable 140 to relay 130. A signal from relay 130 forwards (1) a signal by way of cable 134 to energize the motor 104 to rotate the shaft 102 in a first direction to move the support assembly 14 to the left as viewed in FIG. 2 and (2) a signal by way of cables 136 to the laser 110 and photodetector 62 to energize same.

The support assemblies 26 and 28 remain stationary because their respective brake 114 engages the leg 115 of the member 96. As the support assembly 14 moves into alignment with the scoring assembly 18, the laser beam 111 is incident on the surface of the detector 64. When the laser beam is incident on the center of the detector surface, (1) a signal is forwarded by the detector 64 by way of cables 137 and 138 to cable 126 to energize the brake 114 of the support assembly 14 and (2) a signal is forwarded to the relay 130 by way of cable 137 to (1) deenergize the motor 104 and deenergize the photodetector 62 and laser 110 of the assemblies 14 and 18, respectively.

The peripheral centers of the scoring wheel 16 and land 12 of the assemblies 14 and 18, respectively, are aligned.

The above is repeated to align the peripheral center of the land 12 of the support assemblies 26 and 28 and respective scoring wheel 16 of the scoring assembly 30 and 32, respectively.

The land 12 of the assemblies 14, 26 and 28 is moved upward into alignment with the supporting surface of the conveyor rolls by their respective elevator mechanism 83. The cylinder 42 is operated to extend the piston 40 toward the land and apply a force of about 400 pounds (200 kilograms).

The glass sheet is moved by way of the conveyor between the scoring wheels and land to slit score the glass sheet. The slit scores are spaced about 1¼ feet (0.375 meter) apart.

The piston 40 of the scoring assembly 30 and the elevator mechanism of the support assembly 26 are activated in any conventional manner to move their respective scoring wheel 16 and land 12 away from each other.

The scoring assembly 30 is moved to the right on the member 50 to position its respective scoring wheel 16 from the scoring wheel 16 of the scoring assembly 32 on a center-to-center spacing of about ¾ feet (0.225 meter).

Visual observation indicates that the support assembly 26 has to be moved to the right as viewed in FIG. 2 to align the scoring wheel 16 and land 12 of the assemblies 30 and 26, respectively.

The "R" button of circuit 122 shown in FIG. 7 is depressed to (1) forward a signal by way of cable 128 to disengage the brake 114 of the support assembly 26 and (2) forward a signal by way of cable 132 to the relay 130. The relay 130 of circuit 122 forwards (1) a signal by way of cable 134 to energize the motor 104 to rotate the shaft 102 in a second direction to move the support assembly 26 to the right as viewed in FIG. 2 and (2) a signal by way of cables 136 to energize the laser 110 and detector 62 of the assemblies 30 and 26, respectively.

The support assembly 26 moves to the right as viewed in FIG. 2 while the support assemblies 14 and 28 remain stationary because their respective brakes are in the engaging position.

As the support assembly 26 moves to the right as viewed in FIG. 2, the second glass sheet advances along the conveyor 10. The sheet as it is displaced between the scoring wheel and land of assemblies 18, 32 and 14, 28, respectively, is scored while the laser beam 111 of assembly 26 passes through the second glass sheet incident on the photodetector 62 of the assembly 30. When the laser beam is at the center of the detector, a signal is forwarded from the detector 62 (1) to the relay 130 by way of cable 137 to deenergize the motor 104 and (2) to the brake assembly 112 by way of cables 137, 138 and 126 to engage the brake 114.

The second glass sheet is downstream of the scoring and support assemblies and has slit scores to provide 2 sections 1¼ feet (0.375 meter) and one section 2½ feet (0.75 meter).

The piston 40 and elevator mechanism 86 are energized in any conventional manner to set the scoring wheel 16 and land 12 of the assemblies 30 and 26, respectively, as previously discussed.

The third glass sheet is advanced in the conveyor 10. between the scoring and support assemblies. The third glass sheet is slit scored to provide 2 sections having a width of 1¼ feet (0.375 meter); 1 section 1¾ feet (0.525 meter) and one section ¾ feet (0.225 meter).

As can be appreciated, the invention is not limited to the above examples and other embodiments of the invention may be practiced without deviating from the scope of the invention.

For example, after the glass sheets are slit scored, they can be further scored along a path transverse to the slit scores, i.e., cross scored. Alternatively, the glass sheets may be cross scored and thereafter slit scored in accordance to the teachings of the invention.

What is claimed is:

1. A method of positioning in predetermined spaced relationship respective ones of a first set of a plurality of discrete objects mounted for movement along a first predetermined path with respective ones of a second set of a plurality of discrete objects mounted along a second predetermined path, wherein the first and second predetermined paths are in spaced relationship to one another, comprising the steps of:

mounting the objects of the second set in a predetermined spaced relationship with one another along the second predetermined path;

applying a common force to each of the objects of the first set to simultaneously urge the objects of the first set along the first predetermined path in a direction to position a selected one of the objects of the first set in predetermined spaced relationship with its respective one of the objects of the second set; while preventing movement of the remaining ones of the objects of the first set as the common force moves the selected object of the first set towards its respective one of the objects of the second set to position same in a predetermined spaced relationship to one another; and repeating said applying and preventing steps on the remaining objects of the first set to position the remaining objects of the first set in a predetermined spaced relationship with their respective objects of the second set.

2. The method as set forth in claim 1 wherein each of the discrete objects of one set is a scoring assembly and each of the discrete objects of the other set is a support assembly.

3. The method as set forth in claim 2 further including the step of advancing a glass sheet between the scoring assemblies and support assemblies while practicing said applying and preventing steps.

4. The method as set forth in claim 2 wherein each of the scoring assemblies includes a scoring wheel and each of the support assemblies includes a support wheel and said applying and preventing steps align peripheral centers of the scoring wheels and support wheels.

5. The method as set forth in claim 4 further including the step of advancing a sheet of transparent material between the scoring wheels and the support wheels while practicing said applying and preventing steps.

6. A method of positioning in predetermined spaced relationship respective ones of a first set of objects mounted for movement along a first predetermined path with respective ones of a second set of objects mounted along a second predetermined path, wherein the first and second predetermined paths are in spaced relationship to one another, comprising the steps of:

mounting the objects of the second set in a predetermined spaced relationship with one another along the second predetermined path;

applying a common force to each of the objects of the first set to simultaneously urge the objects of the first set along the first predetermined path in a direction to position selected ones of the objects of the first set in predetermined spaced relationship with their respective ones of the objects of the second set; while preventing movement of the remaining ones of the objects of the first set as the common force moves the selected ones of the first set toward their respective ones of the second set to position same in a predetermined spaced relationship with their respective ones of the second set; and aligning the remaining objects of the first set with their respective objects of the second set.

7. An apparatus for positioning in predetermined spaced relationship respective ones of a first set of a plurality of discrete objects with respective ones of a second set of a plurality of discrete objects, comprising:

means for mounting the objects of the first set in predetermined spaced relationship with one another along a first predetermined path;

means mounting the objects of the second set for movement along a second predetermined path in spaced relationship to the first predetermined path;

means acting on said movement means for applying a common force to the objects of the second set to simultaneously urge the objects of the second set in a predetermined direction along the second predetermined path; and means acting on selected ones of the objects of the second set for preventing movement thereof while a selected one of the objects of the second set is moved by said applying means into predetermined spaced relationship with a selected one of the objects of the first set.

8. The apparatus as set forth in claim 7 further including means for detecting the relative position of the selected object of the second set with its respective object of the first set.

9. The apparatus as set forth in claim 7 further including means for moving a sheet along an article movement path between the first set and second set of objects.

10. The apparatus as set forth in claim 7 wherein the objects of the first set are a plurality of scoring assemblies each having a scoring wheel and the objects of the second set are a plurality of support assemblies each having a support wheel, and further comprising:

means mounting the scoring assemblies on one side of an article movement path for reciprocal movement along the first predetermined path transverse to and spaced from the article movement path; and means mounting the support assemblies on the other side of the article movement path for reciprocal movement along the second predetermined path transverse to and spaced from the article movement path.

11. The apparatus as set forth in claim 10 further including:

means mounting the support assemblies and acting on the support wheel to move the support wheel toward and away from the article movement path; and means mounting the scoring assemblies and acting on the scoring wheel for moving the scoring wheel toward the article movement path under a predetermined pressure and away from the article movement path.

12. The apparatus as set forth in claim 10 further including means for moving a sheet of refractory material along the article movement path wherein the scoring assemblies are mounted above the article movement path and the support assemblies are mounted below the article movement path.

13. The apparatus as set forth in claim 12 wherein the sheet of refractory material is a glass sheet.

14. The apparatus as set forth in claim 10 further including:

means for detecting the relative position of respective ones of the scoring assemblies with respective ones of the support assemblies.

15. The apparatus as set forth in claim 14 wherein said detecting means includes a position photodetector and light generating means.

16. The apparatus as set forth in claim 10 wherein said means for applying a common force is a threaded shaft.

17. The apparatus as set forth in claim 7 wherein the first set of objects are scoring assemblies each having a scoring wheel and the second set of objects are support assemblies each having a support wheel, further comprising:

means mounting the scoring assemblies above an article movement path for reciprocal movement along a predetermined path transverse to and spaced above the article movement path;

means mounting the support assemblies below the article movement path for reciprocal movement along a second predetermined path transverse to and spaced below the article movement path such that a plane normal and transverse to the article movement path intersects the axial center of the scoring wheels and support wheels;

a position photodetector mounting each of the scoring assemblies or support assemblies;

means for generating a collimated beam of light mounting each of the support assemblies or scoring assemblies such that a given output signal from said photodetector indicates alignment of the peripheral centers of respective scoring wheel and support wheel; and means responsive to the output signal of said position photodetector and acting on said applying means to prevent movement of said selected one of the support assemblies when the peripheral center of the support wheel of the selected support assembly is aligned with the peripheral center of its respective scoring wheel.

18. The apparatus as set forth in claim 17 further including means mounting each of the scoring assemblies for moving the scoring wheel under a predetermined force toward the article movement path and away from the article movement path and means mounting each of the support assemblies for moving the support wheel toward and away from the article movement path.

19. The apparatus as set forth in claim 17 wherein said means for applying a common force is a threaded shaft acting on each of the scoring assemblies.

20. The apparatus as set forth in claim 7 further including means acting on said applying means for preventing motion of the at least one object of the first set when aligned with the respective object of the second set.

* * * * *